United States Patent [19]

Cowell

[11] 4,378,501

[45] Mar. 29, 1983

[54] POWER SUPPLY FOR TRIODE X-RAY TUBES

[75] Inventor: David Cowell, Webster, N.Y.

[73] Assignee: Sybron Corporation, Rochester, N.Y.

[21] Appl. No.: 222,287

[22] Filed: Jan. 5, 1981

Related U.S. Application Data

[63] Continuation of Ser. No. 41,999, May 24, 1979, abandoned, which is a continuation of Ser. No. 916,504, Jun. 19, 1978, abandoned.

[51] Int. Cl.[3] ..... H05G 1/30

[52] U.S. Cl. ..... 378/97; 378/106

[58] Field of Search ..... 250/401, 402, 403, 404, 250/405, 413, 421

[56] References Cited

U.S. PATENT DOCUMENTS 3,109,093 10/1963 Arrison ..... 250/413

3,356,847 12/1967 Splain ..... 250/413

3,584,219 6/1971 Hergloty ..... 250/403

4,079,265 3/1978 Woodburn ..... 250/402

OTHER PUBLICATIONS

"Electronics for Scientists and Engineers", R. Benedict, Prentice Hall, 1967, p. 273.

*Primary Examiner*—Craig E. Church

*Attorney, Agent, or Firm*—Robert A. Gerlach; J. Stephen Yeo; Robert J. Bird

[57] ABSTRACT

A power supply provides high voltage for a grid controlled x-ray tube. In the supply an oscillator generates a high frequency signal which is amplified and transformed to kilovoltage. A voltage multiplier increases the kilovoltage to a potential suitable for the tube. The voltage multiplier includes a bank of series capacitors which tends to maintain a constant high voltage when the tube is not conducting.

3 Claims, 3 Drawing Figures

POWER SUPPLY FOR TRIODE X-RAY TUBES

This application is a continuation of application Ser. No. 6/041,999, filed May 24, 1979, which is a continuation of application Ser. No. 916,504 filed June 19, 1978 both now abandoned.

BACKGROUND OF THE INVENTION

This invention pertains to x-ray systems and more particularly concerns a high voltage power supply for grid controlled x-ray tubes.

X-ray tubes are thermionic emission devices and sensitive to both filament temperature and high voltage applied to the tube. Accordingly, most dental x-ray systems now include some sort of feedback circuits to regulate both high voltage and filament current.

A common way to provide high voltage is to apply line voltage to a high turns-ratio transformer, the output of which provides kilovoltage directly across the anode and cathode of the x-ray tube. Because of the high turns ratio required by a direct conversion of the voltage, the high voltage transformers used in previous designs are quite large and bulky. Often there is high flux leakage in the transformer, resulting in a low coupling coefficient and a corresponding reduction of the efficiency of the transformer. Furthermore, because the secondary coil requires many windings, there is high internal resistance. Because of this high resistance, and also because of possible changes in leakage, the voltage across the tube is not constant but varies according to tube current, as well as line voltage. Tube current, however, is highly sensitive to filament temperature and, therefore, accurate means of regulating filament current have been required, including means to pre-heat the filament before the high voltage is applied.

It will be seen that my invention offers substantial improvement over many pre-existing used circuits by meeting the objectives of reducing transformer size, cost and weight, providing an initially constant high voltge, providing compensation for line voltage fluctuations, and less sensitivity to tube current.

SUMMARY OF THE INVENTION

Briefly, in accordance with the invention, an oscillator generates a signal which is amplified and drives a high voltage transformer. The transformed voltage is further increased by a voltage multiplier having a number of series-connected capacitors. The transformed voltage is rectified and stored across each capacitor, the sum voltage being greater than the transformed voltage. The multiplier is connected across the anode and cathode of a triode x-ray tube and provides current when the grid is pulsed. The voltage across the tube may be sampled, and the amplitude of the oscillator signal adjusted to maintain a constant high voltage.

As an additional feature, the number of grid pulses may be counted for the purpose of turning off the x-ray tube when a preset level is reached.

DETAILED DESCRIPTION OF THE INVENTION

Figure 1:
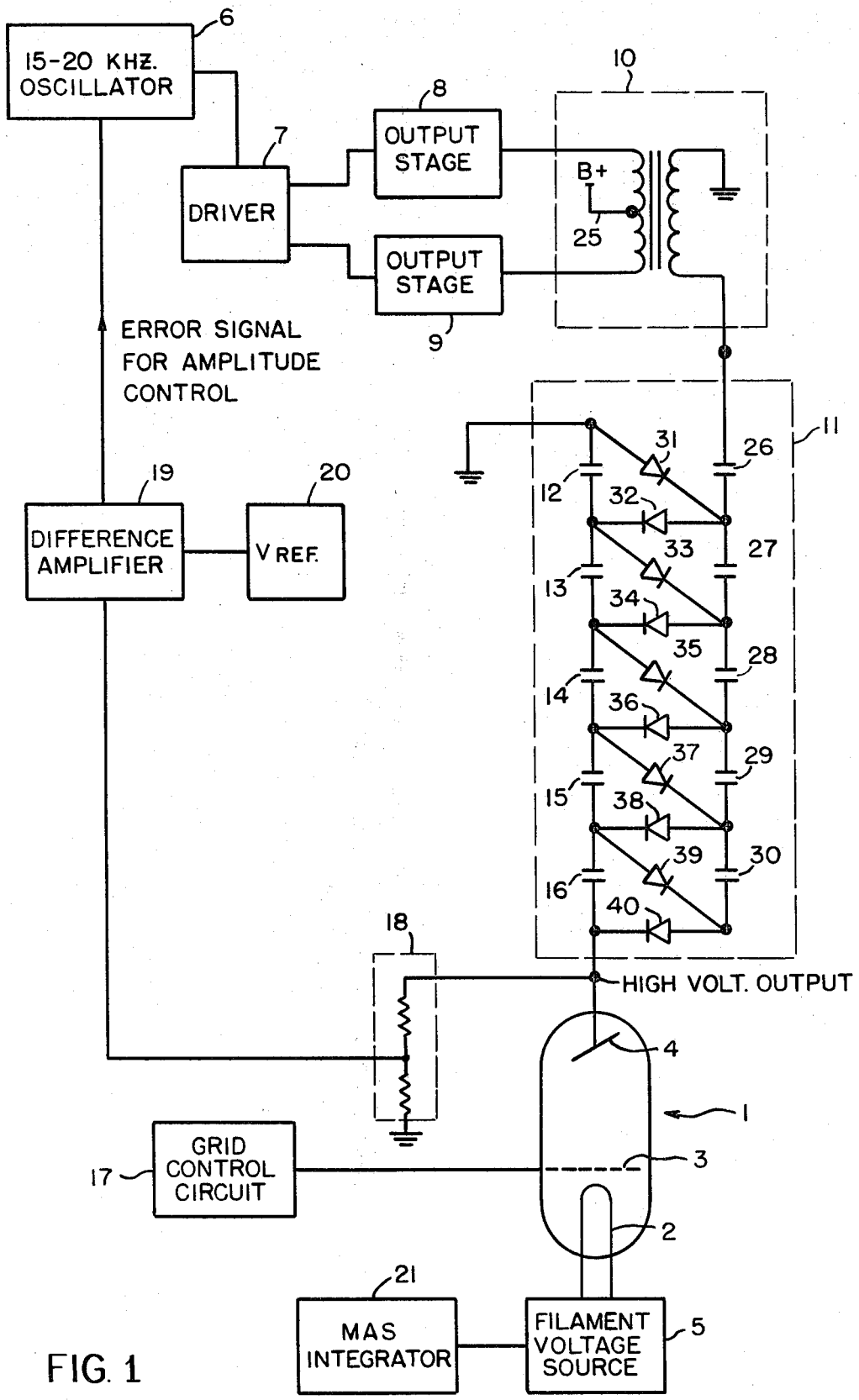
FIG. 1 is a schematic of the preferred embodiment of my invention.

An overview of a circuit embodying my invention is seen in FIG. 1. While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

A triode x-ray tube 1 has a filament-cathode 2, a grid 3 and an anode 4. The cathode 2 is heated by a low voltage source 5. When a high voltage is applied across cathode 2 and anode 4, electrons are emitted from the hot cathode and strike the anode which emits x-rays. The high voltage is in kilovoltage and, in this example, is approximately 65 kilovolts DC. The filament voltage may be 4 v DC. It is a known characteristic of grid-controlled tubes that high voltage may be maintained continuously between the cathode 2 and the anode 4, as the grid 3, which is interposed between cathode and anode will stop electron flow with a grid potential as low as about −200 volts DC.

In the preferred embodiment, an oscillator 6 generates a signal at a frequency many times above that of line frequency. Preferably the oscillator frequency is 15–20 kilohertz compared to the typical line frequency of 50 or 60 hertz.

The output signal from the oscillator 6 is amplified by linear amplifiers, specifically, driver 7 and output stages 8 and 9. The amplified signal is applied across the primary of high voltage transformer 10 and transformed to a high voltage.

Following the preferred embodiment, the transformed voltage is then applied to voltage multiplier 11. The voltage multiplier 11 converts the transformed voltage to a higher, rectified positive voltage and applies it to the anode 4 of x-ray tube 1. The multiplier 11 includes a bank of series capacitors 12, 13, 14, 15, 16 which stores the high voltage until the tube is turned on. The voltage multiplier will be described in more detail later in this specification.

Figure 2:
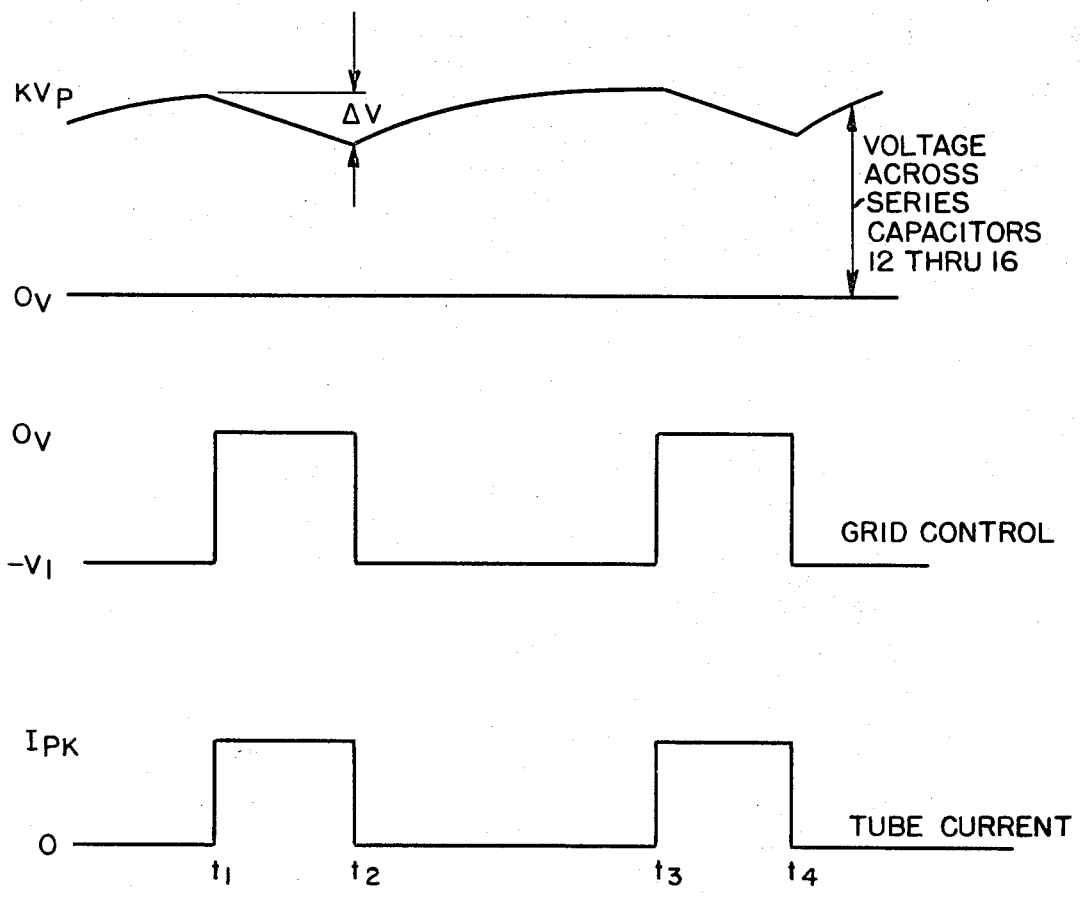
FIG. 2 shows voltage and currents found in the circuit of FIG. 1.

In accordance with the invention, tube 1 is pulsed by a grid control circuit 17 that periodically turns a negative grid voltage on and off for time periods, causing current pulses to flow through the tube during the off time as shown in FIG. 2. The current pulse is on for a short duration (t1 to t2), as for example 150 microseconds, so that the capacitors 12–16 only partially discharge, reducing the voltage across the tube by a value $\Delta V$. Sufficient off time (t2 to t3) is allowed between pulses to allow the capacitors to recharge. I have found that about 750 microseconds of off time is sufficient for recharging the capacitors. This means that in the example there is a 900 microsecond cycle (t1 to t3).

In addition to the voltage variation, $\Delta v$, which is due to the discharge of the capacitors, there may be a longer term high voltage variation due to changes in line voltage. In order to compensate for this line voltage variation, additional circuitry may be provided. As shown in FIG. 1, a voltage divider 18 samples the voltage at the output of the voltage multiplier 11. The sampled voltage is sent to a differential amplifier 19 where it is compared to a reference voltage 20. An error signal is provided by the amplifier which indicates if the voltage appearing at the voltage multiplier is either too high or low. In keeping with the invention, this error signal is directed to the frequency oscillator 6 and used to control the magnitude of the output signal, thereby completing a feedback loop so that the high voltage is maintained constant regardless of line fluctuations.

The use of a bank of multiple capacitors 12–16 in voltage multiplier 11 gives the desirable result of an initial high voltage that is independent of tube current or filament temperature. The discharge rate of the capacitors 12–16, is however, a function of tube current. It is, for the purpose of controlling tube current, still desirable to provide a regulated filament voltage source and to provide a pre-heat time period for the filament to reach temperature before the tube conducts. Nevertheless the high voltage appearing across the x-ray tube will be more nearly constant and independent from filament temperature than many circuits known in the prior art.

The present invention is also concerned with x-ray dosage, which is a function of both the kilovoltage across the tube and the tube current integrated over time. A milliamp-second integrator 21 may be provided which turns the circuitry off when the current-time integral reaches a certain level. Several current integrating circuits are known, as for example, those disclosed in U.S. Pat. No. 4,039,811 and U.S. Pat. No. 3,284,631.

Alternatively, as an additional feature of the invention, the number of grid pulses may be counted by pulse counter. Since the kilovoltage is fairly constant and the filament is regulated, the tube current will be approximately constant. If the grid pulses are of uniform duration, the tube current over time product may be found by simply counting the pulses. When the number of pulses reach a predetermined quantity, the tube may be turned off by means of the grid or by removing the high voltage.

In the preferred construction, the cathode is close to ground potential. Therefore, as an advantage of my invention, tube current may be measured merely by inserting an analog ammeter between the cathode and ground. The ammeter will read the average tube current. Since the tube is pulsed, the average current need only be multiplied by a constant to obtain the peak tube current, which may be used for adjusting the circuitry.

Figure 3:
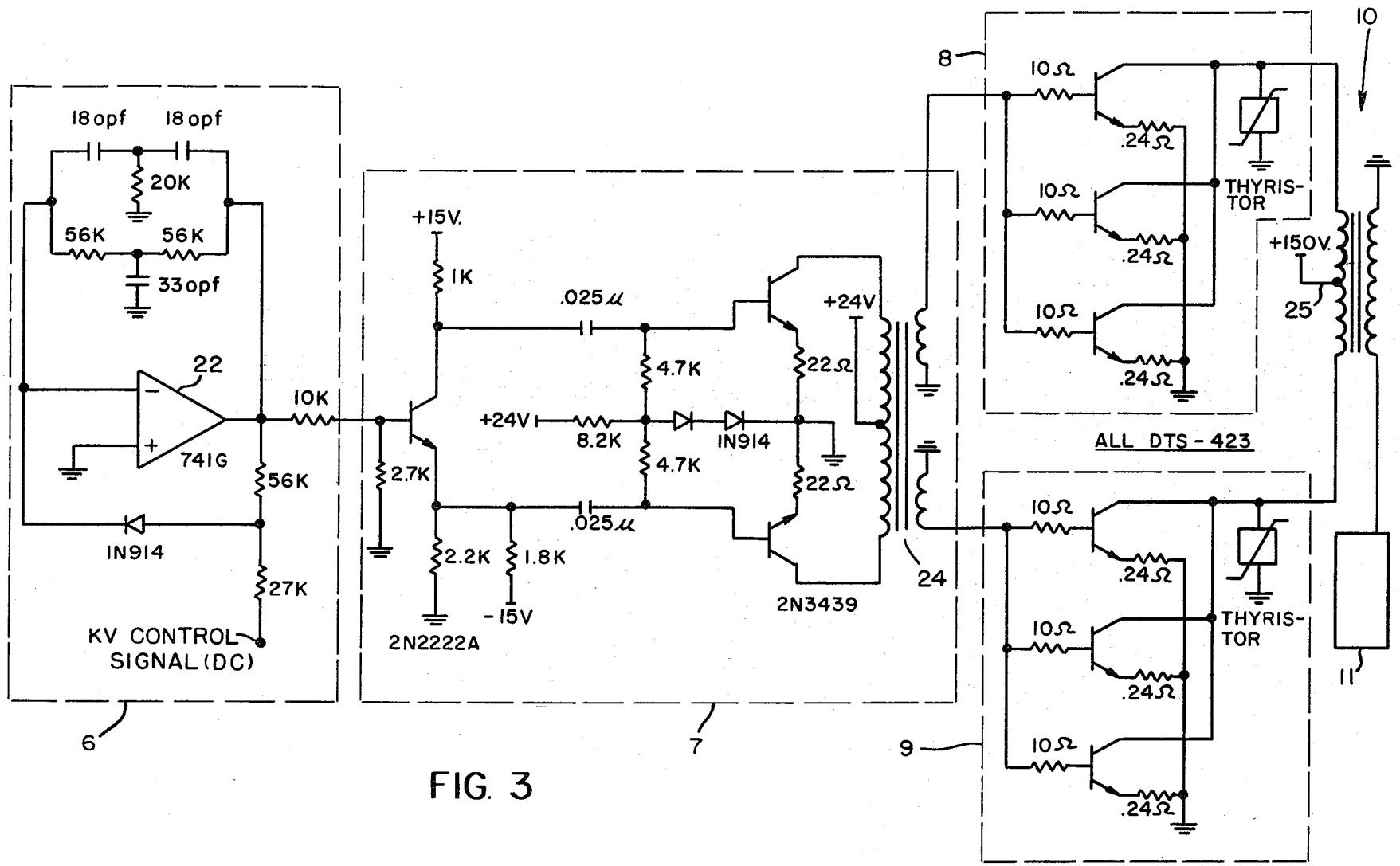
FIG. 3 shows in detail some of the elements of FIG. 1.

FIG. 3 depicts some of the components of the circuit in further detail. Typical component values are given as examples only.

Oscillator 6 includes an operational amplifier having an RC feedback loop arranged to cause oscillation. An output signal from oscillator 6 has a frequency between 15–20 kilohertz which is directed to driver 7 which first amplifies the signal and then feeds it to a phase splitting transformer 24. Transformer 24 provides two signals of opposing phase which are then directed to the two push-pull power amplifiers 8, 9, which amplify the signals to sufficient power to drive the primary of the high voltage transformer 10 with 160 volts, peak to peak. The peak to peak secondary transformed voltage appearing across the secondary is about 13 KV and is connected to voltage multiplier 11.

The details of a high voltage transformer suitable for practicing the invention will now be given. The high voltage transformer consists of a primary winding of 80 turns of 22 gauge wire wound upon a core of high permeability material. Wound upon the primary winding is a secondary coil having twenty layers of 160 turns each of 40 gauge wire. The turns ratio is 80:1 compared to the 400:1 turns ratio of a conventional transformer. The primary winding may be center tapped, which allows B+ voltage to be delivered to the push-pull power amplifiers 8, 9. The core of the transformer should a high flux material, such as Stackpole 3C5. The geometry of the core is a rectangle of 3 by $2\frac{3}{4}''$ outside dimensions having $\frac{1}{8}$ inch square arms.

In the illustrated form, one advantage of the invention is that transformer size, and size, weight and cost are less with the present design.

We return to FIG. 1 to study voltage multiplier 11, which is seen to have a plurality of stages. Each stage of the multiplier consists of two capacitors and two diodes arranged as shown in the drawing. I used 1200 pf ceramic capacitors having a working voltage of 20 kilovolts.

The first stage includes capacitors 12 and 26 and diodes 31 and 32. Capacitor 26 and diode 31 DC restores the secondary voltage to a positive value above ground which is rectified to DC by diode 32 and capacitor 12. The proces is repeated by succeeding stages. Five stages may be used to obtain an output of about 65 kilovolts. The components of the four remaining stages are capacitors 13–16, diodes 33–40 and capacitors 27–30. The 65 KV potential is retained by the bank of series capacitors 12, 13, 14, 15, 16 until the tube 1 conducts, causing the capacitors to partially discharge.

Several additional advantages are offered by my invention over circuits commonly used in the past. For instance, the efficiency of the circuit is much greater, using only 195 watts compared to 1200 watts measured in a previous circuit. Furthermore, it is known that when voltage is held in a bank of capacitors, an instantaneous power draw from line is not observed as in some other units, resulting in less line swing. In some earlier units, impulse currents up to 1000 amperes were observed on the line when high voltage was turned on. Also, since the oscillator is running at a relatively high frequency and the grid control pulse is also relatively fast compared to a 50–60 hertz system, the error signal can be made more responsive thereby controlling the output kilovoltage much more accurately than is possible than with a 50 or 60 hertz system.

Thus, it is apparent that there has been provided, in accordance with the invention, a power supply that fully satisfies the objectives and advantages set forth above. While the invention has been described in conjunction with a specific and preferred embodiment thereof, it is evident that many alternatives, modifications, and variations will be apparent to those skilled in the art in light of the foregoing description. Accordingly, it is intended to embrace all alterations, modifications and variations as fall within the spirit and broad scope of the appended claims.

I claim:

1. An X-ray power supply comprised of:

an x-ray tube having a cathode, a grid, and an anode;

an oscillator for generating a signal at a frequency substantially higher than line frequency;

at least one linear amplifier connected to said oscillator to amplify said signal;

a transformer having a primary and a seconary, the primary connected to said amplifier for transforming the amplified signal to a higher voltage across the secondary;

a voltage multiplier, interposed between said secondary and the tube to provide a rectified voltage between the anode and the cathode at a multiple of the peak to peak voltage of the transformed amplified signal;

pulse means for applying a plurality of voltage pulses to the tube grid resulting in a plurality of current pulses through the tube and corresponding plurality of x-ray emissions; and dosage means for turning off the X-ray when the current pulses integrated overtime corresponds to a desired X-ray dosage.

2. The X-ray power supply of claim 1 wherein the dosage means is a milliamp-second current integrator.

3. The X-ray power supply of claim 2 where the dosage means is a counter which counts the number of voltage pulses at the grid and turns the tube off when the number of voltage pulses reaches a value corresponding to desired dosage.

* * * * *